United States Patent [19]

Ferguson

[11] Patent Number: 5,027,993

[45] Date of Patent: Jul. 2, 1991

[54] PERFORATED PAPER FEED APPARATUS WITH AN OPTICAL SYSTEM FOR DETECTING THE PRESENCE AND/OR MOTION OF THE PAPER

[75] Inventor: Gregory A. Ferguson, New Bedford, Mass.

[73] Assignee: Precision Handling Devices, Inc., Fall River, Mass.

[21] Appl. No.: 393,203

[22] Filed: Aug. 14, 1989

[51] Int. Cl.[5] ..... B65H 20/00

[52] U.S. Cl. ..... 226/74; 400/616.1; 400/581; 226/24; 226/45

[58] Field of Search ..... 226/74, 75, 45, 24, 226/25, 43; 250/570; 235/458; 353/26 A; 400/581, 708, 711, 616.1, 616.2

[56] References Cited

U.S. PATENT DOCUMENTS

| | | | |
|---|---|---|---|
| 2,769,922 | 11/1956 | Peery | 250/570 |
| 2,862,233 | 12/1958 | Brown | 226/24 X |
| 3,751,152 | 8/1973 | Rinehart | 353/26 A |
| 3,958,735 | 5/1976 | Wanat | 226/43 X |
| 4,485,949 | 12/1984 | Gebhart et al. | 226/45 X |
| 4,734,868 | 3/1988 | DeLacy | 400/616.1 X |

*Primary Examiner*—Daniel P. Stodola
*Assistant Examiner*—Paul Thomas Bowen
*Attorney, Agent, or Firm*—Martin LuKacher

[57] ABSTRACT

A perforated paper feed mechanism such as a tractor has an optical system for detecting the presence of the form and particularly the motion of the form and utilizes a reflector which may be mounted on the lid of the tractor at one end of the tractor (where the paper enters or leaves the tractor). The optical system may be implemented by a prism which folds the path of light from a light source (an LED) to a photo detector (a phototransistor) the path is aligned with the perforations in the paper. Since the perforations are spaced, the photo transistor provides a train of pulses as the paper is fed by the tractor. A pulse detector responds to the presence or absence of pulses within a given period of time comparable to the time when perforations are fed past the optical path. An output from the detector thus indicates whether the paper is in motion and is being fed by the tractor. Failure to receive pulses indicates either the absence of paper (paper out) or a jam in the feed.

6 Claims, 4 Drawing Sheets

PERFORATED PAPER FEED APPARATUS WITH AN OPTICAL SYSTEM FOR DETECTING THE PRESENCE AND/OR MOTION OF THE PAPER

The present invention relates to perforated paper feed devices utilizing optical means for sensing that the perforated paper is being fed (paper motion) by the feed device.

The invention is especially adapted for use with tractor feeds such as described in U.S. Pat. No. 4,129,239 issued Dec. 12, 1978 to L. J. Hubbard and provides a means for detecting motion of the paper thereby indicating when the paper is jammed or is not present (paper out).

It has been proposed to use feelers which operate switches to detect the presence of paper in a feed device such as a tractor. Another approach is to use an optical system responsive to reflection from the surface of the paper which senses the presence of feed holes from the absence of reflection. Since all types of papers do not have high reflectivity, such arrangements may not be reliable. Another approach is to use a light source and a light detector. The light source is positioned above the paper and responds to light transmitted through the perforations to detect the motion of the paper. Such devices interfere with the loading of the form, for example, the wires connected to the sensor (either the light source or the photo detector) interfere with the loading of the paper.

It is an object of the present invention to provide and improve perforated paper feed which is low in cost and is capable of reliably sensing the motion of the paper and whether the paper is jammed, or is present or absent in the feed device.

Briefly described, a perforated paper feed mechanism in accordance with the invention includes a light source and a light detector. A light reflecting means spaced from the source and detector to define a gap through which the paper travels provides a folded light path between the source and the detector. This folded light path is aligned with the perforations in the form so that the light is transmitted through the perforations in impulses as the form travels. These pulses are separated in time corresponding to the velocity of the paper and the spacing of the perforations. Pulse detection circuits, which respond to the presence of successive pulses of electrical signals corresponding to the light pulses, provides an output indicating that the form is in motion. The output may be the presence of a voltage level indicating the presence of the moving perforated paper or the absence of the voltage level or a voltage of opposite polarity to indicate the absence of the paper or that it is jammed and not in motion.

The foregoing and other objects, features and advantages of the invention will become more apparent from a reading of the following description in connection with the accompanying drawings in which.

Figure 1:
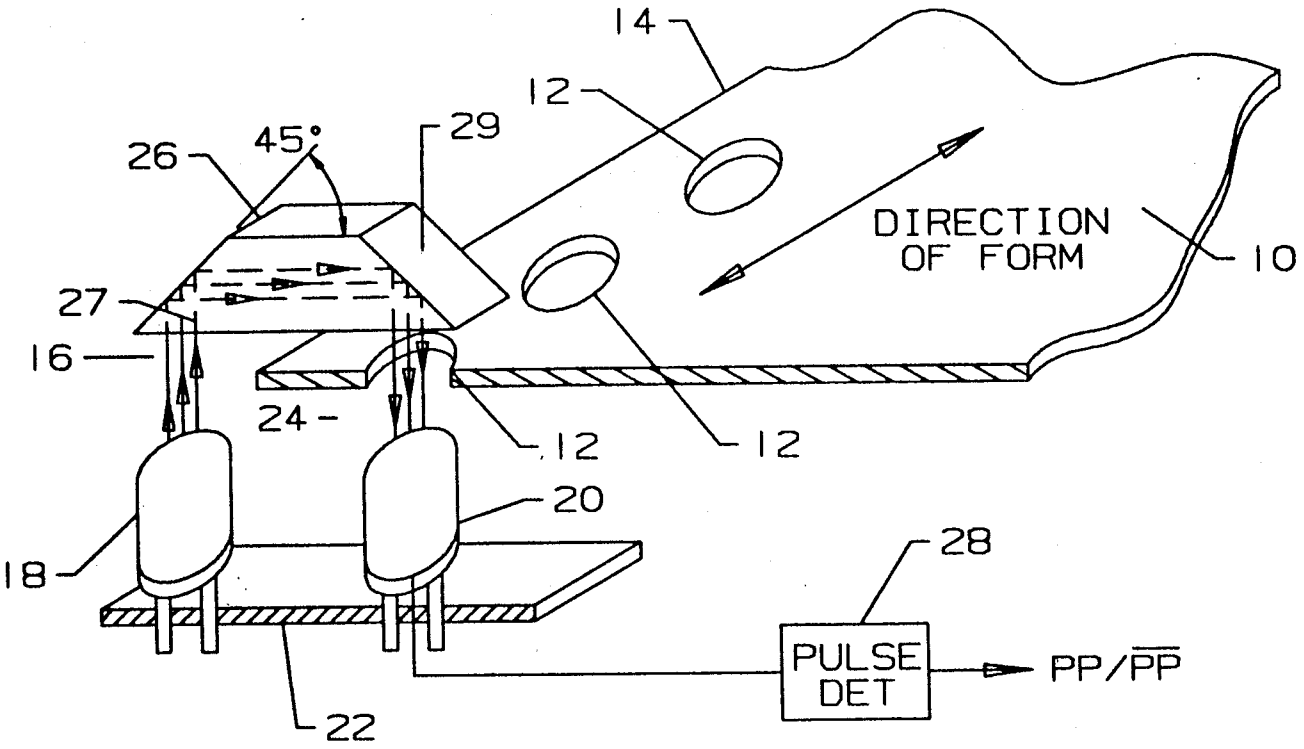
FIG. 1 is a schematic perspective view of an optical and electronic system for sensing the motion of perforated paper in accordance with the invention.

Referring first to FIG. 1, there is shown a perforated paper such as a continuous computer form 10. This paper has perforations 12 spaced at equal distances in the direction of travel of the form (along an edge 14 of the form) and spaced inwardly from the edge 14. An optical system 16 provides a paper motion detector. It includes a light source such as a lamp or light emitting diode (LED) 18 and a photo detector 20, such as a phototransistor, mounted on a bracket 22.

Spaced from the light source and lamp by a gap 24 through which the paper 10 travels, is a light reflecting device, specifically a prism 26 which provides a folded optical path between the lamp and the detector. This path is outside the edge 14 and in alignment with the perforations. Accordingly, when the paper is in motion a succession of optical pulses (a pulse train) is generated. This pulse train is detected by the detector 20 and applied as electrical pulse to a pulse detector 28. The pulse detector may for example be a time out circuit which provides a positive voltage level PP when the pulses occur within a given period of time corresponding to the spacing and time of the pulses, which of course corresponds to the spacing of the perforations and the velocity of travel of the form 10. In the event that the pulses are not received with proper timing by the detector, a complimentary output which may be a zero voltage level or a voltage level of opposite polarity, shown in FIG. 1 as not PP is provided. The output PP/not PP indicates that the form is in motion or is absent in the gap 24 or is not moving (is jammed).

Figure 2:
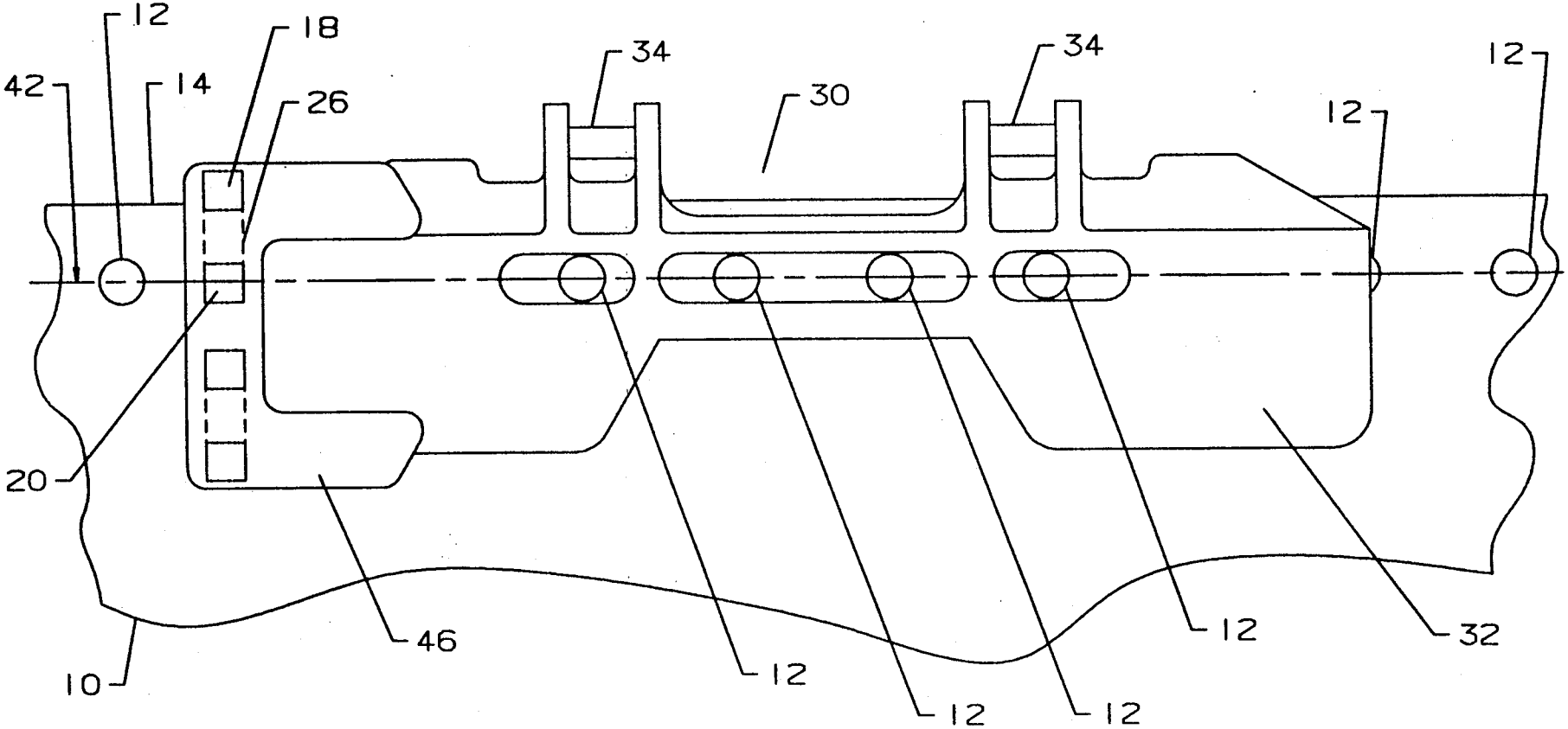
FIG. 2 is a plan view of a tractor having a perforated paper motion sensor in accordance with the invention.
Figure 3:
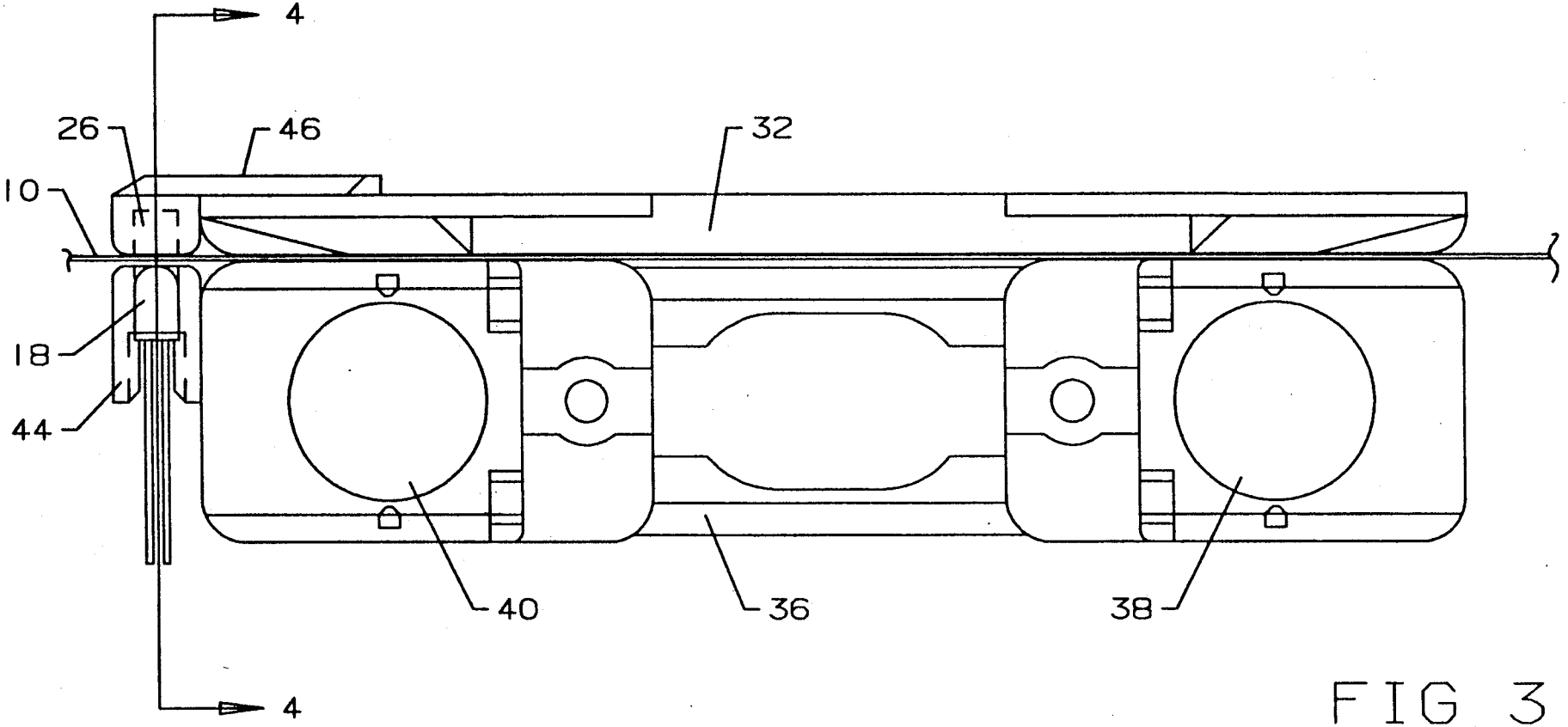
FIG. 3 is a front view of the tractor shown in FIG. 2.
Figure 4:
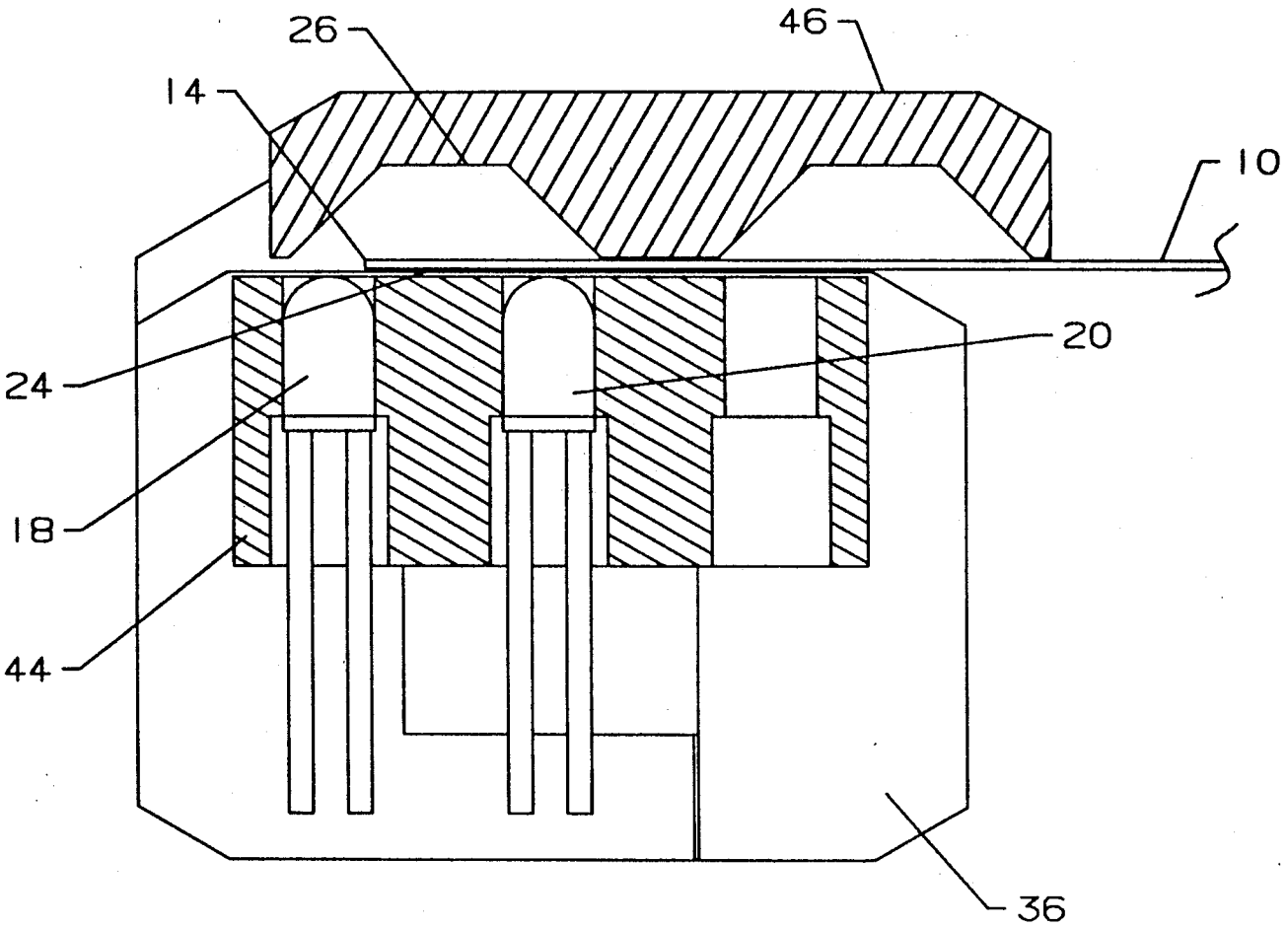
FIG. 4 is a sectional view, the section being taken along the line 4—4 in FIG. 3.

Referring to FIGS. 2, 3 and 4 there is shown a tractor 30 of a design similar to that illustrated in the above referenced patent. The tractor has a lid which is pivotal on pins 34. The tractor also has a frame 36 within which the tractor belt is entrained and is driven by a feed sprocket the location of which is shown at 38 around an idler sprocket, the location of which is shown at 40. The feed and idler sprockets may be interchanged. The tractor shown is a Model 5600 series Xactron (R) tractor (left side unit) sold by Precision Handling Devices, Inc., Fall River, Mass.

The tractor belt has pins which are received in the perforations 12 of the paper and feeds the paper so that the edge 14 is spaced from the line of perforations 12. The line along which the perforations travel is indicated at 42. The photo transistor which provides the detector 20 and an LED which provides the light source or lamp 18 is mounted in a housing 44 attached to one end of the frame 36 of the tractor. It is shown in the Figures as the input end or leading or downstream end of the tractor 30.

It will be observed that the housing 44 has space for another light source or detector. This facilitates mounting on other tractors which I used on the opposite side (along the edge of the form 10 opposite to the edge 14). Mounted in a bracket 46 attached to the lid 32 at the downstream end of the lid is the prism 26. There is room in the bracket 46 for another prism so that the bracket may be used in applications where it is to be mounted on the tractor which is disposed along the opposite side of the form 10. It will be seen that the edge 14 of the form is clear of the LED 18 so that light from the LED passes through the gap, is folded by the prism 26, and then passes downwardly along a path perpendicular to the path 42 along which the perforations travel when fed by the tractor. The inclined sides 27 and 29 of the prism may be coated with reflective material (e.g., silver spray paint) to assure folding of the light path. Appropriate sources of voltage and the pulse detector circuitry 28 are connected to the LED 18 and the photo transistor 20.

Since the prism is located above the form, such that the light from the lamp 18 is reflected over the path of the form, the detector can sense the presence of a hole or the absence of the hole (a perforation). If the form does not move, the optical signal pulses are not received by the photo detector 20, thereby indicating a "jam" or paper out condition. The location of the prism on the movable element (Lid 32 of the tractor) allows both the detector and lamp to be mounted so that wires therefrom do not interfere with the loading of the paper. The system is also not dependent upon the reflectivity of the form.

From the foregoing description it will be apparent that there has been provided improved perforated paper feed apparatus which reliably detects the motion, absence or "jam" of the perforated paper form. Variations and modifications of the invention may suggest themselves to those skilled in the art. For example, instead of a prism, those surfaces which are shown disposed along the oppositely inclined walls of the slot in the bracket 46 which receive the prism may be coated with reflective material. Other variations and modifications within the scope of the invention will undoubtedly suggest themselves to those skilled in the art. Accordingly, the foregoing description should be taken as illustrative and not in any limiting sense.

I claim:

1. In a perforated paper feed mechanism an optical system for detecting the motion of paper having perforation holes which comprises a source of illumination which generates light and a photo detector spaced from each other so that at least one thereof is in alignment with the perforations in the paper, optical means for defining a retrovertedly folded path for the light between the source and the photodetector, which path passes through the paper across the paper and outside the paper, and means responsive to the presence or absence of optical pulses from the photodetector for indicating the motion of the form.

2. The invention as set forth in claim 1 wherein the optical path folding means is a prism spaced from the source and detector by a gap through which the paper passes.

3. The invention as set forth in claim 1 further comprising a tractor having a lid and a frame for feeding the paper, a bracket containing said optical means, and a housing containing said light source and photo detector, one of said bracket and housing being mounted on said lid while the other of said bracket and housing is mounted on said frame, at both the same end of said tractor.

4. The invention as set forth in claim 3 wherein said bracket contains a prism and is mounted on said lid and said housing contains said light source and said detector and is mounted on said frame.

5. The invention as set forth in claim 4 wherein said paper has an edge, holes spaced along the line spaced inwardly from said edge, said lid has inside and outside edges paralleling said line, means disposed along said inside edge pivotally mounting said lid, said tractor has means for feeding said paper with said edge thereof inwardly disposed from said inside edge of said lid, said prism having parallel top and bottom faces and side faces between which said light path extends, said prism being disposed with said side faces on opposite sides of said edge of said paper.

6. The invention as set forth in claim 1 wherein said paper has an edge, said holes being spaced along the line parallel to said edge and spaced inwardly therefrom, said optical means being disposed so that said folded path bridges said edge.

* * * * *